US005186350A

United States Patent [19]

McBride

[11] Patent Number: 5,186,350

[45] Date of Patent: Feb. 16, 1993

[54] INSULATED BEVERAGE CONTAINER HOLDER

[76] Inventor: Larry D. McBride, Rte. 1, Box 712, Rogers, Ark. 72756

[21] Appl. No.: 720,206

[22] Filed: Jun. 24, 1991

[51] Int. Cl.[5] ..... B65D 25/18

[52] U.S. Cl. ..... 220/412; 206/818; 220/483; 220/636; 220/729; 220/739; 220/740

[58] Field of Search ..... 220/339, 412, 483, 636, 220/729, 739, 740; 206/818

[56] References Cited

U.S. PATENT DOCUMENTS

| | | | |
|---|---|---|---|
| D. 229,156 | 11/1973 | Mousette . | |
| 2,217,514 | 10/1940 | Henry | 206/818 |
| 2,954,891 | 10/1960 | Imber | 220/412 |
| 3,023,922 | 3/1962 | Arrington et al. | 220/412 |
| 3,556,341 | 1/1971 | Rains . | |
| 3,610,459 | 10/1971 | Hanson | 206/818 |
| 3,642,122 | 2/1972 | Von Ende | 206/818 |
| 3,730,374 | 5/1973 | Picciano et al. | 220/414 |
| 3,763,996 | 10/1973 | Shepherd | 206/818 |
| 4,040,549 | 8/1977 | Sadler . | |
| 4,119,248 | 10/1978 | Butler et al. | 220/412 |
| 4,127,211 | 11/1978 | Zerbey . | |
| 4,341,307 | 7/1982 | Shyers | 220/339 |
| 4,403,712 | 9/1983 | Wizsinger | 220/339 |
| 4,484,682 | 11/1984 | Crow . | |
| 4,523,083 | 6/1985 | Hamilton . | |
| 4,541,540 | 8/1985 | Gretz et al. | 220/412 |
| 4,573,600 | 3/1986 | Dubach | 220/339 |
| 4,720,023 | 1/1988 | Jeff . | |
| 4,735,333 | 4/1988 | Lay et al. . | |
| 4,778,071 | 10/1988 | Fillmore | 220/339 |

FOREIGN PATENT DOCUMENTS 2829440 7/1978 Fed. Rep. of Germany .

*Primary Examiner*—Joseph Man-Fu Moy
*Attorney, Agent, or Firm*—Boyd D. Cox

[57] ABSTRACT

An insulated beverage container holder includes a cylindrical hollow body portion connected to a cylindrical hollow cap by an integrally molded flexible plastic loop hinge. A hollow cylindrical insulating foam liner cup is dimensioned for removable insertion into the cylindrical body. The hollow interior of the liner cup is dimensioned to removably receive standard sized beverage containers, such as cans and bottles. An upstanding annular ledge on the open upper end face of the body cooperates with an annular step provided on the bottom end face of the cap to form a frictional closure. A thumb catch disposed on the cap, diametrically opposite the hinge, facilitates manual opening and closing the cap. A disk-shaped, thin, cylindrical end plate is integrally molded as a component of said cylindrical body proximate a bottom end face of the hollow body. The end plate forms a floor which supports a bottom surface of the liner cup. A magnet in a steel mounting cup is secured to the end plate in a manner which disposes an exposed bottom surface of the magnet flush with the bottom end face of the body. A steel anchor plate is secured to an intended mounting surface by cooperating hook and loop type fasteners. The container holder may be removably mounted on the surface by releasable magnetic engagement with the anchor plate.

12 Claims, 3 Drawing Sheets

INSULATED BEVERAGE CONTAINER HOLDER

BACKGROUND OF THE INVENTION

Field of the Invention

The present invention relates to insulated beverage container holders, and more particularly pertains to an insulated beverage container holder having a removable foam liner cup dimensioned to receive standard sized beverage containers.

SUMMARY OF THE INVENTION

Representative embodiments of the concepts of the present invention are illustrated in the drawings and make use of an insulated beverage container holder which includes a cylindrical hollow body portion connected to a cylindrical hollow cap by an integrally molded flexible plastic loop hinge. A cup-shaped cylindrical insulating foam liner cup is dimensioned for removable insertion into the oylindrioal body. The hollow interior of the liner cup is dimensioned to removably receive standard sized beverage containers, such as cans and bottles. An upstanding annular ledge on the open upper end face of the body cooperates with an annular groove provided on the end face of the cap to form a frictional closure. A thumb catch disposed on the cap, diametrically opposite the hinge, facilitates manual opening and closing of the cap. A disk-shaped, thin, cylindrical end plate is integrally molded as a component of the cylindrical hollow body portion proximate the bottom end thereof. The end plate forms a floor which supports a bottom surface of the liner cup. A magnet in a steel mounting cup is secured to the end plate in a manner which disposes an exposed bottom surface of the magnet flush with the bottom end face of the body. A steel anchor plate is secured to an intended mounting surface by cooperating hook and loop type fasteners. The beverage container holder may be removably mounted on the surface by releasable magnetic engagement with the anchor plate.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved insulated beverage container holder which has all the advantages of the prior art insulated beverage container holders and none of the disadvantages.

It is another object of the present invention to provide a new and improved insulated beverage container holder which may be easily and efficiently manufactured and marketed.

It is a further object of the present invention to provide a new and improved insulated beverage container holder which is of a durable and reliable construction.

An even further object of the present invention is to provide a new and improved insulated beverage container holder which is susceptible of a low cost of manufacture with regard to both materials and labor, and which accordingly is then susceptible of low prices of sale to the consuming public, thereby making such insulated beverage container holders economically available to the buying public.

Still yet another object of the present invention is to provide a new and improved insulated beverage container holder which provides in the apparatuses and methods of the prior art some of the advantages thereof, while simultaneously overcoming some of the disadvantages normally associated therewith.

Still another object of the present invention is to provide a new and improved insulated beverage container holder having a removable insulating foam liner cup to facilitate cleaning of the liner and holder.

Yet another object of the present invention is to provide a new and improved insulated beverage container holder having a magnetic mechanism for securing the holder to a desired surface.

Even still another object of the present invention is to provide a new and improved insulated beverage container holder having a bottom end provided with drain holes for draining condensation from the interior.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
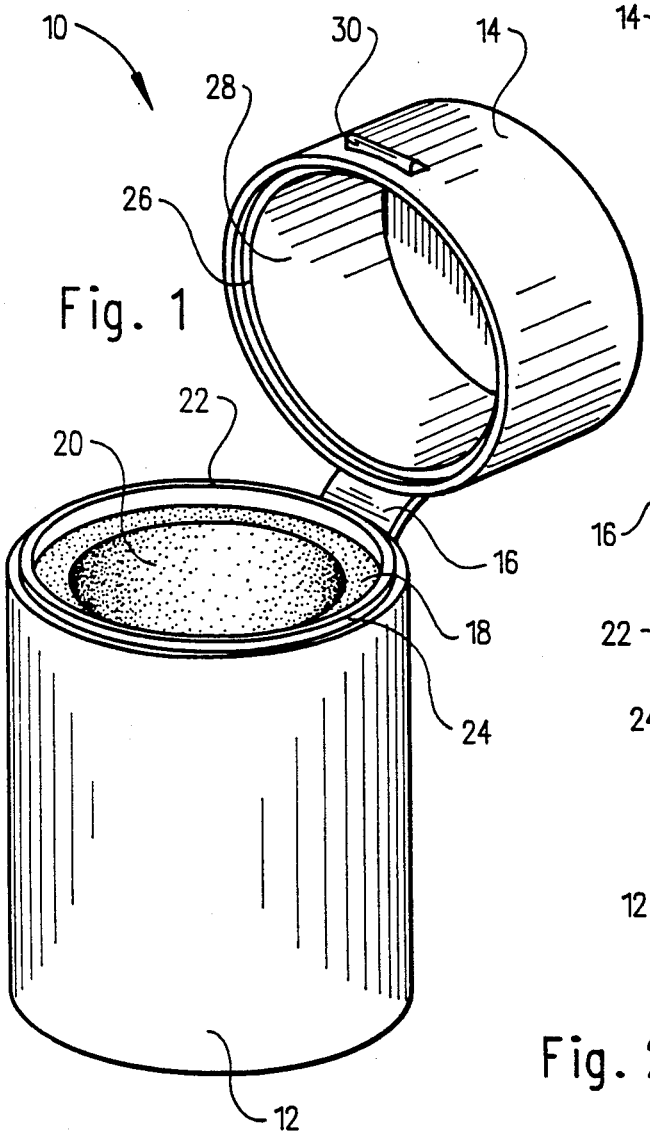
FIG. 1 is a perspective view of the insulated beverage container holder of the present invention, with the cap in an open position.

With reference now to the drawings, and in particular to FIG. 1 thereof, a new and improved insulated beverage container holder embodying the principles and concepts of the present invention and generally designated by the reference numeral 10 will be described.

More specifically, it will be noted that the first embodiment 10 of the invention includes an elongated cylindrical hollow body 12 and a hollow cylindrical cap 14. The body 12 and cap 14 are preferably molded from a plastic material and connected by an integral flexible loop hinge 16. An insulating foam liner cup 18 is preferably formed from a soft, open cell insulating plastic foam material. The liner cup 18 is dimensioned to be removably received within the hollow interior of the body 12, and has a hollow interior portion 20 dimensioned to removably receive standard sized beverage containers, such as cans and bottles. An upstanding annular ledge 22 is formed on an upper end face of the body 12 and forms a step or shoulder 24. An annular step 26 is formed on a bottom end face of the cap 14, and is dimensioned to receive the upstanding ledge 22 therein. The cooperating frictional engagement of the ledge 22 within the step 26 forms a releasable frictional closure for the cap 14. A thumb catch 30 is disposed on the cylindrical side wall of the cap 14 in a position diametrically opposite the hinge 16. The thumb catch 30 facilitates manual opening and closing of the cap 14.

Figure 3:
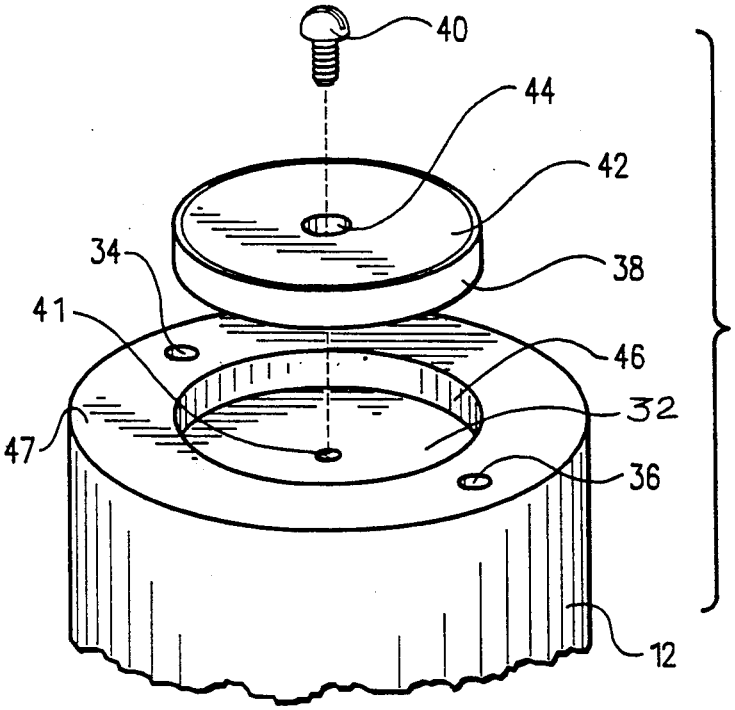
FIG. 3 is a partial exploded perspective view illustrating the bottom end portion of the insulated beverage container holder of the present invention.
Figure 6:
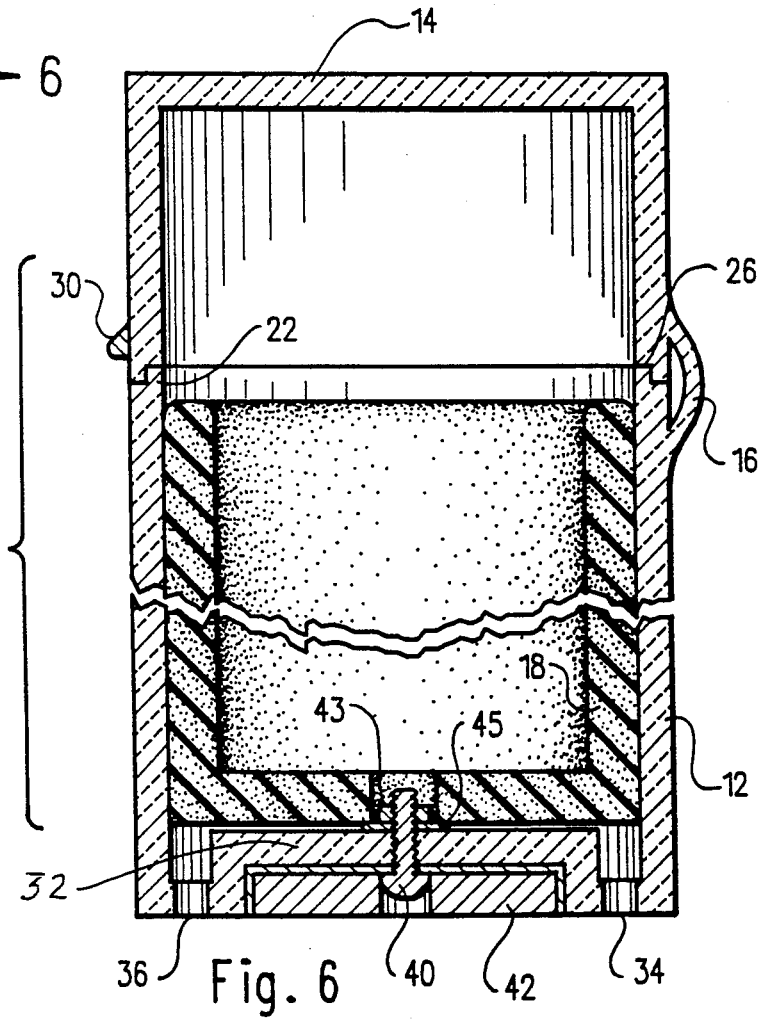
FIG. 6 is a longitudinal cross sectional view, taken along line 6—6 of FIG. 5.

With reference to FIGS. 3 and 6, a bottom end plate 32, which is integrally molded as a component of the hollow body 12 proximate the bottom end face 47, is in the form of a shallow cylindrical disk. The bottom end face 47 is provided with drain holes 34 and 36 to facilitate the draining of condensate from the interior of the body 12 and liner cup 18. This draining system allows moisture which condenses on the cold exterior surface of a beverage container to flow through the open cell foam material of the liner 18 and through the drain holes 34 and 36. The mounting cup 38 has a central hole 39 which receives a screw 40 therethrough. The screw 40 also extends through a central enlarged hole 44 in a disk-shaped magnet 42 and through a central hole 41 in the bottom end plate 32. A nut 43 and a washer 45 cooperate with the screw 40 to secure the mounting cup 38 and attached magnet 42 to the bottom end plate 32.

As can be appreciated from FIG. 3, the mounting cup 38 and magnet 42 are received in a recess 46 formed adjacent the bottom end face 47 of the body 12. The recess 46 is formed by spacing the end plate 3 slightly axially above the bottom end face 47.

Figure 4:
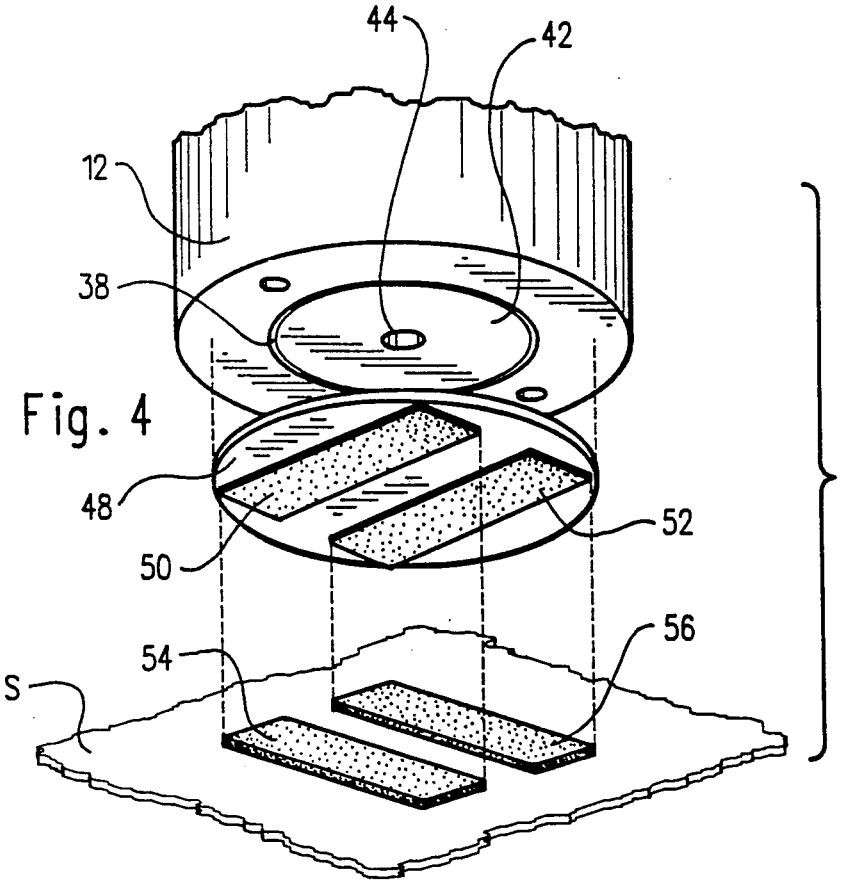
FIG. 4 is a partial exploded perspective view illustrating the magnetic mounting mechanism for securing the insulated beverage container holder to an intended mounting surface.
Figure 5:
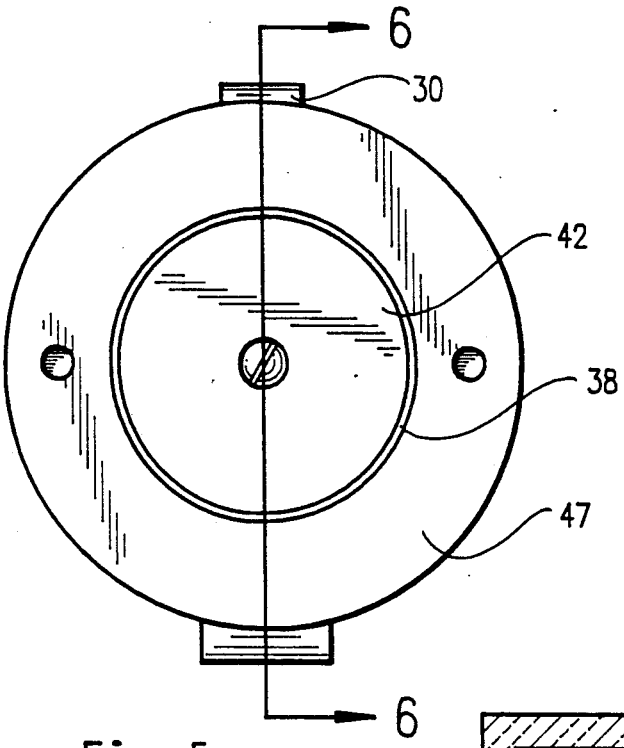
FIG. 5 is a bottom plan view of the insulated beverage container holder of the present invention.

As illustrated in FIG. 4, a cylindrical disk-shaped steel anchor plate 48 includes a pair of spaced cooperating hook and loop type fasteners 50 and 52, for example of the type sold under the trademark VELCRO. Similar cooperating hook and loop type fasteners 54 and 56 may be adhesively secured to an intended mounting surface S. In use, the steel anchor plate 48 is secured to the surface S through engagement of the fasteners 50 and 52 with the cooperating fasteners 54 and 56. The magnet 42, having an exposed bottom surface flush with the bottom end face 47 of the body 12, may then be releasably magnetically secured to the steel anchor plate 48, for the purpose of maintaining the beverage container holder at a desired location. In the event that the intended mounting surface S is formed from a ferrous material, then the steel anchor plate 48 may of course be omitted, and the magnet 42 engaged directly with the surface S.

Figure 2:
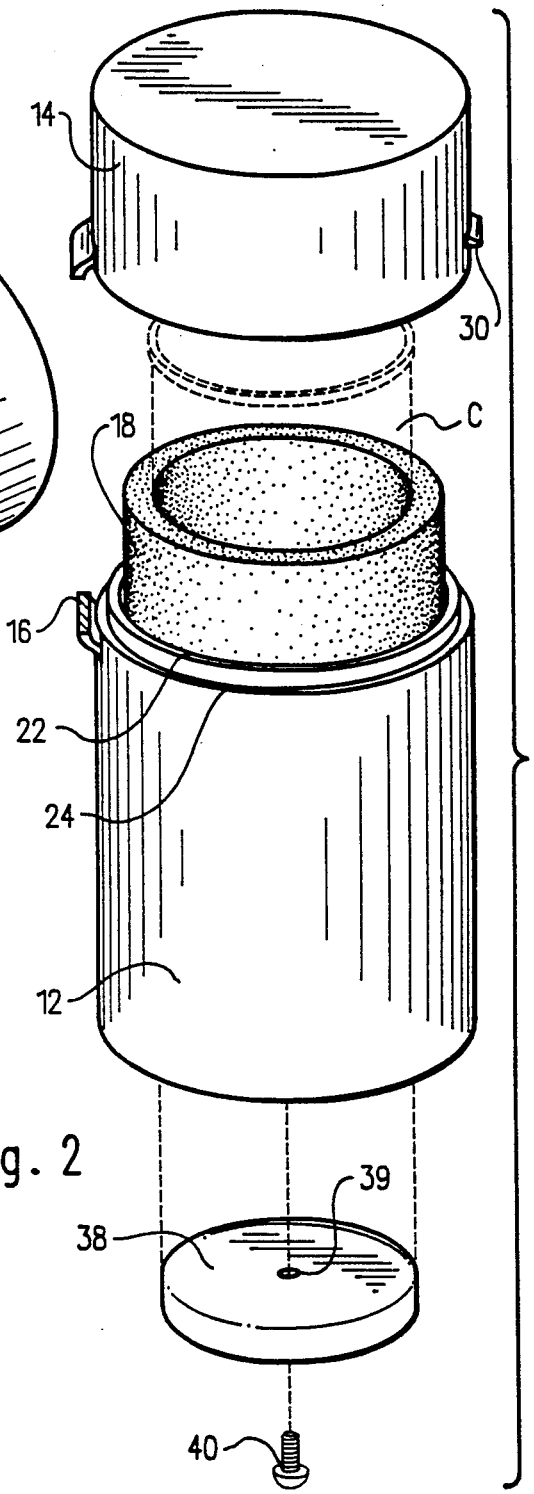
FIG. 2 is an exploded perspective view of the insulated beverage container holder of the present invention.

As shown in FIG. 2, the liner cup 18 is dimensioned to receive a standard sized beverage container, for example a conventional 12 ounce soda can C. The same size liner cup 18 may also be utilized for insulating a standard 10 ounce size beverage container bottle.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An insulated beverage container holder, comprising:

a hollow cylindrical body;

a hollow cylindrical cap dimensioned for engagement with an open upper end face of said body;

an upstanding annular ledge on said upper end face of said body;

a step connecting said ledge with an outer cylindrical side wall of said body;

an annular groove formed in an open bottom end of said cap, said groove dimensioned for frictional engagement with said ledge for retaining said cap in a closed position over said upper end face of said body;

a radially outwardly projecting thumb catch on said cap for opening said cap;

an insulating liner removably received in said body;

a flexible hinge integrally molded with said body and said cap;

a cylindrical disk-shaped end plate integrally molded as a component of said body proximate a bottom end face of said body, said end plate forming a floor supporting said liner;

a downwardly opening cylindrical cup-shaped steel mounting cup secured externally to said end plate;

a magnet disposed in said mounting cup such that a bottom surface of said magnet is exposed and disposed flush with said bottom end face of said body; and at least one drain hole in said bottom end face of said body.

2. The insulated beverage container holder of claim 1, wherein said thumb catch is disposed diametrically opposite said hinge.

3. The insulated beverage container holder of claim 1, wherein said liner is formed from a plastic foam material.

4. The insulated beverage container holder of claim 1, wherein said liner has a hollow interior dimensioned to removably receive a beverage container.

5. The insulated beverage container holder of claim 1, wherein said end plate is positioned slightly axially above said bottom end face forming a recess adjacent said bottom end face.

6. The insulated beverage container holder of claim 1, further comprising a steel anchor plate for magnetic engagement with said magnet and means for securing said anchor plate to a surface.

7. The insulated beverage container holder of claim 6, wherein said means for securing said anchor plate comprises cooperating hook and loop fasteners.

8. The insulated beverage container holder of claim 1, further comprising cooperating threaded fasteners securing said mounting cup to said end plate.

9. An insulated beverage container holder, comprising:

a hollow cylindrical body;

a hollow cylindrical cap dimensioned for engagement with an open upper end face of said body;

an insulating liner removably received in said body;

a cylindrical disk shaped end plate integrally molded as a component of said body proximate a bottom end face of said body, said end plate forming a floor supporting said liner;

said end plate positioned slightly axially above said bottom end face forming a recess adjacent said bottom end face;

a cylindrical downwardly opening cup-shaped steel mounting cup secured to said end plate; and a magnet disposed within said mounting cup and possessing an exposed surface disposed flush with said bottom face of said body; and at least one drain hole in said bottom end face of said body.

10. The insulated beverage container holder of claim 9, further comprising a steel anchor plate for magnetic engagement with said magnet and means for securing said anchor plate to a surface.

11. The insulated beverage container holder of claim 10, wherein said means for securing said anchor plate comprises cooperating hook and loop fasteners.

12. An insulated beverage container holder, comprising:

a hollow cylindrical body;

an upstanding annular ledge on an open upper end face of said cylindrical body;

a step connecting said ledge with an outer cylindrical side wall of said cylindrical body;

a hollow cylindrical cap connected to said cylindrical body by an integral flexible hinge;

an annular groove formed in an open bottom end of said cap, said groove dimensioned for frictional engagement with said ledge for retaining said cap in a closed position over said upper end face of said cylindrical body;

a radially outwardly projecting thumb catch on said cap disposed diametrically opposite said hinge for opening said cap;

a hollow cylindrical insulating liner formed from a plastic foam material removably received in said cylindrical body;

said liner having a hollow interior dimensioned to removably receive a beverage container;

a cylindrical disk-shaped end plate integrally molded as a component of said cylindrical body proximate a bottom end face of said cylindrical body, said end plate forming a floor of said cylindrical body for supporting said liner thereupon;

a shallow cylindrical cup-shaped steel mounting cup;

a disk-shaped magnet in said cup;

aligned central holes formed through said magnet, said mounting cup, and said end plate;

cooperating threaded fasteners securing said mounting cup to said end plate in a manner such as said magnet is disposed flush with said bottom end face of said cylindrical body;

a steel anchor plate dimensioned for engagement with said magnet; and cooperating hook and loop fastening means for securing said anchor plate to a surface whereby said insulated beverage container holder may be releasably magnetically secured to said surface.

* * * * *